US007147400B2

(12) United States Patent
Van Der Poel

(10) Patent No.: US 7,147,400 B2
(45) Date of Patent: Dec. 12, 2006

(54) ROAD MARKING SYSTEM

(75) Inventor: Lucas Leo Desiree Van Der Poel, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/503,460

(22) PCT Filed: Jan. 17, 2003

(86) PCT No.: PCT/IB03/00106

§ 371 (c)(1),
(2), (4) Date: Aug. 3, 2004

(87) PCT Pub. No.: WO03/066968

PCT Pub. Date: Aug. 14, 2003

(65) Prior Publication Data

US 2005/0220538 A1 Oct. 6, 2005

(30) Foreign Application Priority Data

Feb. 5, 2002 (EP) ..... 02075475

(51) Int. Cl.
*E01F 9/00* (2006.01)

(52) U.S. Cl. ..... 404/9; 116/63 R; 340/932; 362/153.1

(58) Field of Classification Search ..... 404/9, 404/12; 340/907, 932; 359/551, 552; 362/153.1; 116/63 R See application file for complete search history.

(56) References Cited

U.S. PATENT DOCUMENTS

| | | | | | |
|---|---|---|---|---|---|
| 2,457,968 | A | * | 1/1949 | Allen et al. | 340/332 |
| 3,188,927 | A | * | 6/1965 | Woods | 404/9 |
| 3,604,781 | A | * | 9/1971 | Gaeth et al. | 359/552 |
| 3,750,099 | A | * | 7/1973 | Proctor | 340/932 |
| 3,768,383 | A | * | 10/1973 | Tucker | 116/63 R |
| 3,817,596 | A | * | 6/1974 | Tanaka | 359/532 |
| 4,236,788 | A | * | 12/1980 | Wyckoff | 359/551 |
| 4,886,687 | A | * | 12/1989 | Malott | 428/4 |
| 5,673,039 | A | * | 9/1997 | Pietzsch et al. | 340/905 |
| 5,822,119 | A | * | 10/1998 | Rasmussen et al. | 359/515 |
| RE36,878 | E | * | 9/2000 | Waitts et al. | 430/1 |
| 6,305,874 | B1 | * | 10/2001 | Custers et al. | 404/9 |
| 6,789,915 | B1 | * | 9/2004 | Van Der Poel et al. | 362/153.1 |

FOREIGN PATENT DOCUMENTS

GB 2 299 358 * 10/1996

* cited by examiner

*Primary Examiner*—Gary S. Hartmann
(74) *Attorney, Agent, or Firm*—Larry Liberchuk

(57) ABSTRACT

The road-marking system is described for influencing a flow of traffic consisting of vehicles traveling over a roadway. The road-marking system comprises a plurality of road marking units. The road marking units are provided with at least one light source for emitting light in the direction of a driver of the vehicle In operation, the road-marking system generates a guidance light which seemingly moves along with the flow of traffic and is generated by suitably switching on and off the light source in the road marking units. According to the invention spectral characteristics of the light emitted by the guidance light is dependent on the angle under which the light is emitted, wherein the speed of the guidance light is independent of the flow of the traffic.

7 Claims, 2 Drawing Sheets

ROAD MARKING SYSTEM

Figure 1:
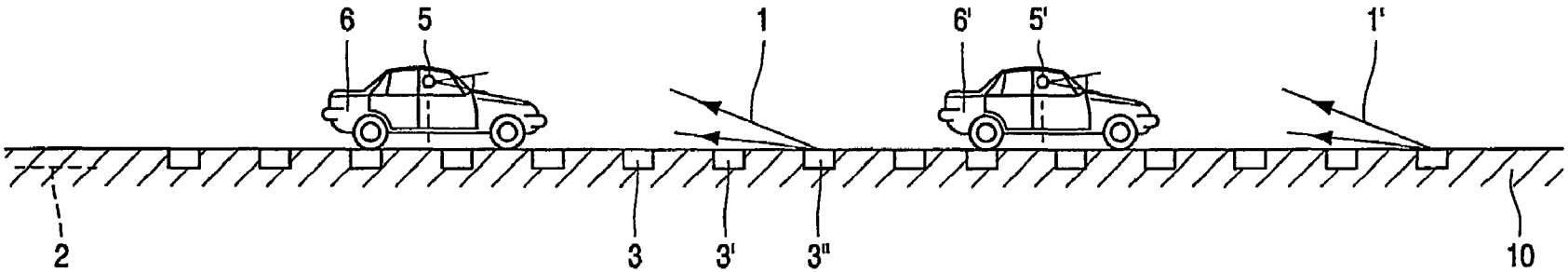

The invention relates to a road-marking system for influencing a flow of traffic consisting of vehicles traveling over a roadway, which road-marking system comprises a plurality of road marking units, the road marking units being provided with at least one light source for emitting light in the direction of a driver of the vehicle, the road-marking system, in operation, generating a guidance light which seemingly moves along with the flow of traffic and is generated by suitably switching on and off the light source in the road marking units.

Such road-marking systems are used in traffic control systems for marking traffic routes for vehicles, such as roads for cars and other road users. One of the methods used by traffic planners in their attempts to reduce traffic jams is a so-called "tidal flow system". In such a dynamic system, the direction of the traffic of multi-lane roads is changed for one or more lanes in accordance with the direction of the main flow of traffic. In an alternative embodiment, the number of lanes available to traffic moving in a specific direction is increased or reduced, dependent upon the amount of traffic. A problem with these methods relates to indicating, in a flexible manner, the direction of the desired flow of traffic for a specific lane, or to changing the arrangement of the traffic route in a flexible manner. Known means for indicating the desirable direction of the flow of traffic include signaling lights beside or above the traffic route.

Such road marking can also be given static applications. Such applications include the marking of parts of traffic routes (for example straight parts or bends) so as to control the direction of the traffic under certain weather conditions, for example during fog, rain, black ice, etc., and/or under certain light conditions, such as daylight, twilight, a low position of the sun, night, etc, and/or in tunnels.

Road-marking systems can be provided in a road surface of the traffic route but also beside and/or above the traffic route, for example on a crash barrier at the side of the traffic route.

A road-marking system of the type mentioned in the opening paragraph is disclosed in WO 00/20691. In said document, a description is given of a system for creating marking lines in a road surface by means of light originating from suitable light sources provided in road marking units, said marking lines being visible at some distance from the vehicle and being perceived as full or interrupted marking lines. In the known road-marking system it is achieved that a driver of a vehicle, for example a motorist or a truck driver who, from his vehicle, looks ahead at the traffic on the road and the markings in the road surface, observes at some distance that the light beams originating from the road marking units demonstrate a uniform overlap. The light originating from the road marking units is perceived as an imaginary full marking line under said conditions.

A drawback of the known road-marking system resides in that said road-marking system cannot be used to influence a flow of traffic consisting of vehicles traveling over a roadway.

It is an object of the invention to provide a road-marking system of the type described in the opening paragraph, which obviates said drawback. According to the invention, a road-marking system of the kind mentioned in the opening paragraph is for this purpose characterized in that the spectral characteristics of the light emitted by the guidance light is dependent on the angle under which the light is emitted, wherein the speed of said guidance light is independent of the flow of the traffic.

By means of the measure in accordance with the invention, it is achieved that a driver, for example a motorist or a truck driver who, from his vehicle, looks ahead at the traffic on the road, observes a guidance light in front of his car, which guidance light seemingly moves along with the flow of traffic. Said guidance light is situated somewhere between the driver's vehicle and the vehicle in front of the driver's vehicle in the flow of traffic. The spectral characteristics (e.g. the color) of the light emitted by the guidance light influences the driver to adapt the speed of his vehicle. If the angle of observance of the light from the guidance light is too high (the vehicle is too close to the guidance light), the spectral characteristics of the light emitted by the guidance light are such (e.g. red) that the driver is influenced to slow down the speed of his vehicle. When the driver diminishes the speed of his vehicle, the driver will notify that the spectral characteristics of the light emitted by the guidance light changes to the desired spectral characteristics (e.g. green). In this manner a safe distance between the vehicles and/or a safe intensity of the vehicles in the flow of traffic is achieved.

The road-marking system is preferably provided in the road surface. The light source generating the guidance light preferably comprises a plurality of light sources (for example 4, 8, 10, 15 or 20 LEDs) which are arranged next in the road surface, next to each other and transversely to the driver's direction of view. Said light sources are so closely spaced that they cannot be individually distinguished by the human eye.

The road-marking system is preferably provided approximately in the center of the roadway or lane. This has the advantage that this location is suitable for giving visual information because the driver generally looks straight ahead. In addition, the other, mostly painted, road marking can be preserved. Besides, a road-marking system provided in the center of the roadway or lane is subject to a comparatively small mechanical load.

To create the impression that the guidance light moves along with the flow of traffic, the light source in successive road marking units is switched on and off. By setting the time between switching on and off of the successive road marking units, the guidance light thus is given a desired speed by suitable switching.

Dependent of the desired traffic flow the characteristics of the movement of the guidance lights are set by the desired intensity level of the traffic or by the desired distance between vehicles. Given the speed of the guidance light, the drivers will gradually adapt the speed and mutual distance between their vehicles, as a result of which a safe distance between the vehicles and/or a safe speed of the vehicles in the flow of traffic is achieved. To this end, a preferred embodiment of the road-marking system in accordance with the invention is characterized in that the spectral characteristics of the light emitted by the guidance light as perceived by the driver of the vehicle is dependent on the distance between the vehicle and the guidance light.

A preferred embodiment of the road-marking system in accordance with the invention is characterized in that the color of the light emitted by the guidance light as perceived by the driver of the vehicle is green when the distance between the vehicle and the guidance light is in a desired range. A green or greenish color is associated with safety. The driver adapts the speed of his vehicle such that he sees a green light from the guidance light. The magnitude of the desired range is set by the situation. If, by way of example in a tunnel, it is necessary for safety reasons to have a distance between the vehicles larger than e.g. 100 m, the road-marking system is set such that green light is emitted by the guidance light. If the driver substantially deviates from the desired velocity and for distance, the driver sees another color of the light emitted by the guidance light.

A preferred embodiment of the road-marking system in accordance with the invention is characterized in that the color of the light emitted by the guidance light as perceived by the driver of the vehicle is red or orange when the distance between the vehicle and the guidance light is outside the desired range. A red, orange, amber, or yellow color is associated with danger. The driver adapts the speed of his vehicle such to avoid seeing such colored light from the guidance light. The magnitude of the desired range is set by the situation. If the driver adapts the speed of his vehicle to fit into the desired range (by adapting the distance to the previous vehicle), the driver will see another color of the light (e.g. green) emitted by the guidance light which the driver perceives as safe.

Preferably, the road-marking system generates a plurality of guidance lights so as to make sure that at least one guidance light is visible between each one of the vehicles. This enables the speed of and/or the mutual distance between a large number of vehicles forming part of a flow of traffic and traveling over this road segment, to be influenced by the road-marking system.

For the light source use is preferably made of a light-emitting diode (LED). Preferably, the luminous flux of the light-emitting diode is at least 5 lm during operation. Light-emitting diodes, also referred to as optoelectronic elements or electro-optic elements, can particularly suitably be used as the light source. The light-emitting diode element is preferably mounted in the road-marking unit. A comparatively high luminous flux is necessary to generate enough light also in ambient light conditions, such as sunlight or light originating from headlights, so that the light beam is noticeable from a distance.

As an alternative light source for use in the road-marking system, use can very suitably be made of an end portion of an optical fiber. This has the advantage that the light emitted by the light source is generated in a light generator at a distance from the road-marking unit and transferred from the light generator to the light source by means of optical fibers. The light generator may comprise a light source accommodated in the housing, for example a semiconductor light source such as a light-emitting diode, or a discharge lamp such as a mercury discharge lamp.

These and other aspects of the invention will be apparent from and elucidated with reference to the embodiment(s) described hereinafter.

Figure 2:
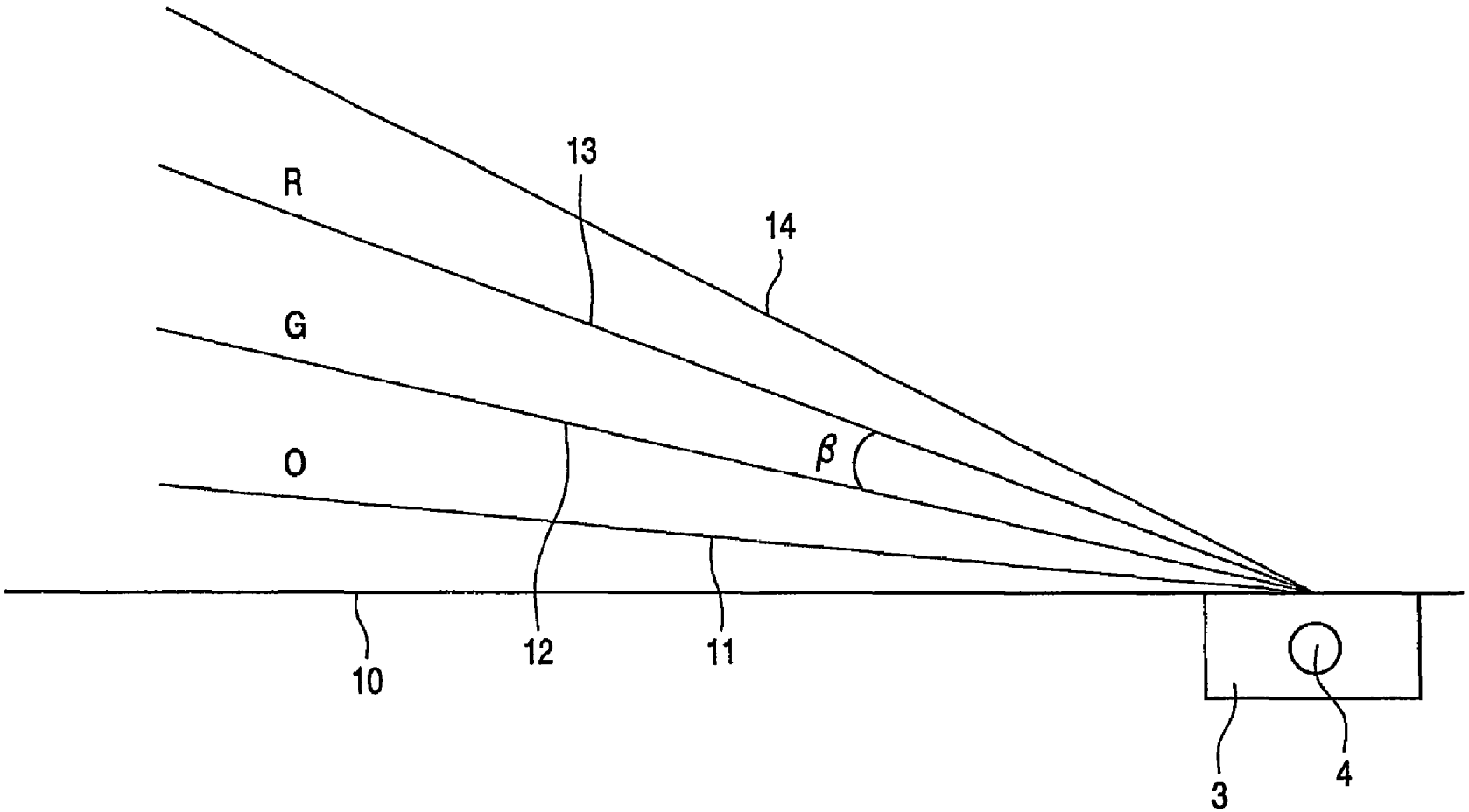

In the drawings:

FIG. 1 is a cross-sectional view of a road-marking system in accordance with the invention, and FIG. 2 is a cross-sectional view of a guidance light with spectral characteristics as a function of the angle.

The Figures are purely diagrammatic and not drawn to scale. Particularly for clarity, some dimensions are exaggerated strongly. In the drawings, like reference numerals refer to like parts whenever possible.

FIG. 1 show, in a very schematic manner, a cross-sectional view of a road-marking system for influencing a flow of traffic consisting of vehicles 6, 6', . . . traveling over a roadway 10. Said road-marking system comprises a plurality of road marking units 3; 3', 3", . . . . Each one of said road marking units 3, 3', 3", . . . is provided with a light source 4 (not shown in FIG. 1; see FIG. 2) for emitting light in the direction of a driver 5, 5', . . . of one of the vehicles 6, 6', . . . . In the situation shown in FIG. 1, two guidance lights 1, 1', . . . which seemingly move along with the flow of traffic are generated by suitably switching on and off the light source in the road marking units 3, 3', 3", . . . In the example shown in FIG. 1, road marking unit 3" emits light in the direction of driver 5 of vehicle 6 at a certain point in time. By suitably switching on and off the light source 4 in the road marking units 3, 3', 3", . . . it is achieved that the flow of traffic moves along with the guidance lights 1, 1', . . . According to the invention, the spectral characteristics of the light emitted by the guidance light 1, 1', . . . is dependent on the angle under which the light is emitted.

FIG. 2 shows, in a schematic manner, a cross-sectional view of a guidance light with spectral characteristics as a function of the angle. For simplicity reasons only one road-marking unit 3 is shown in FIG. 2. The road-marking unit 3 comprises a light source 4 which emits light. Alternatively, the road-marking unit 3 may comprise a plurality of light sources, each, for example, emitting a different spectral characteristics in dependence of the angle under which the light is emitted by the light source 4. In the example of FIG. 2, the light emitted by the guidance lights 1, 1', . . . in the direction of the driver 5, 5', . . . of the vehicle 6, 6', . . . is colored in dependence of the angle between the road way and the direction into which the light is emitted towards the driver. This is advantageous because the light appears to have different colors depending in the distance of the vehicles 6, 6' . . . to the road marking units 3, 3', 3" . . . . If the vehicle is too close to the guidance light, the emitted light may e.g. be red (R) or orange (O), whereas in case the distance between the guidance light and the vehicle is in the desired range, the emitted light may be green (G). In the example of FIG. 2, orange light is emitted in the area encompassed by the lines 11 and 12, green light is emitted in the area encompassed by the lines 12 and 13, and red light is emitted in the area encompassed by the lines 13 and 14.

Preferably, the opening angle β of the green light beam is in the range from 0.5 to 10°, preferably between 1 and 7°. In table 1 the opening angle β of the green beam is calculated as a function of the height of the driver, the velocity of the vehicle, and the time spacing between vehicles. The height of the driver in the vehicle (in meters) is given respective to the roadway. Given the velocity of the vehicle (in km/hr as well as in m/s) and the desired time spacing (in seconds) between subsequent vehicles (preferably 1 or 2 seconds), the opening angle β is given in Table 1.

TABLE 1

Opening angle β of the green beam as a function of the height of the driver, the velocity of the vehicle, and the time spacing between vehicles.

| | | height driver (m) | | | |
|---|---|---|---|---|---|
| | | 1.2 | 1.2 | 1.5 | 1.5 |
| | | time spacing between vehicles (s) | | | |
| velocity of the vehicle | | 1 | 2 | 1 | 2 |
| km/hr | m/s | opening angle β (in degrees) | | | |
| 50 | 13.8 | 4.8 | 2.4 | 6.1 | 3.0 |
| 60 | 16.6 | 4.0 | 2.0 | 5.0 | 2.5 |
| 70 | 19.44 | 3.4 | 1.7 | 4.3 | 2.2 |
| 100 | 27.7 | 2.3 | 1.1 | 2.9 | 1.4 |

At relatively high speed (100 km/hr), for a height of the driver at 1.5 m and for a time spacing between two subsequent vehicles of 2 s, the opening angle β is approximately 1,4°. At relatively low speed (50 km/hr), for a height of the driver at 1.2 m and for a time spacing between two subsequent vehicles of 1 s, the opening angle β is approximately 4,8°.

The coloring of the light emitted by the guidance lights 1, 1', . . . greatly improves the safety of the road-marking system. To enhance the recognition of the light emitted by the guidance light 1, 1', . . . , the light is flashing.

It will be obvious that, within the scope of the invention, many variations are possible to those skilled in the art.

The scope of protection of the invention is not limited to the examples described hereinabove. The invention is embodied in each novel characteristic and each combination of characteristics. Reference numerals in the claims do not limit the scope of protection thereof. The use of the term "to comprise" does not exclude the presence of elements other than those stated in the claims. The use of the article "a" or "an" in front of an element does not exclude the presence of a plurality of such elements.

The invention claimed is:

1. A road-marking system for influencing a flow of traffic consisting of vehicles traveling over a roadway, comprising:

a plurality of road marking units juxtaposed with the roadway, and each provided with at least one light source for emitting light in a direction of a driver of the vehicle, the road-marking system being operative to generate a guidance light by suitably switching on and off the at least one light source in the road marking units, wherein the spectral characteristics of the guidance light are dependent on an angle under which the light is emitted from the at least one light source relative to the roadway, and wherein the speed of switching on and off of the at least one light source is independent of the flow of the traffic.

2. A road-marking system as claimed in claim 1, wherein the spectral characteristics of the guidance light is dependent on the distance between the vehicle and the guidance light.

3. A road-marking system as claimed in claim 1, wherein the color of the guidance light is green when the distance between the vehicle and the guidance light is in a desired range.

4. A road-marking system as claimed in claim 2, wherein the color of the guidance light is red or orange when the distance between the vehicle and the guidance light is outside a desired range.

5. A road-marking system as claimed in claim 1, wherein the road-marking system generates a plurality of guidance lights so as to make sure that at least one guidance light is visible between each one of the vehicles.

6. A road-marking system as claimed in claim 1, wherein the road-marking system is provided in the middle of the roadway.

7. A road-marking system as claimed in claim 1, wherein the road-marking system is arranged on at least one side of the roadway.

* * * * *